US006524660B2

(12) United States Patent
Quiel et al.

(10) Patent No.: US 6,524,660 B2
(45) Date of Patent: Feb. 25, 2003

(54) SYSTEM FOR COATING USING A GROOVED BACKING ROLLER AND ELECTROSTATIC ASSIST

(75) Inventors: Robert R. Quiel, Penfield, NY (US); Fernando Ramos, Jr., Rochester, NY (US); Daniel C. Lioy, Rochester, NY (US); David A. Wakefield, Canandaigua, NY (US); Mark C. Zaretsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 85 days.

(21) Appl. No.: 09/799,377

(22) Filed: Mar. 5, 2001

(65) Prior Publication Data

US 2002/0164431 A1 Nov. 7, 2002

(51) Int. Cl.[7] ..... B05D 1/26; B05D 1/04

(52) U.S. Cl. ..... 427/472; 427/420; 427/428

(58) Field of Search ..... 427/458, 472, 427/473, 420, 428; 118/258, 259, 407, 410, 419, 621, 661; 101/153; 226/193, 196.1; 242/615.4

(56) References Cited

U.S. PATENT DOCUMENTS 3,405,855 A 10/1968 Daly et al.
4,426,757 A 1/1984 Hourticolon et al.
4,428,724 A * 1/1984 Levy
4,837,045 A 6/1989 Nakajima
6,177,141 B1 * 1/2001 Billow et al.

FOREIGN PATENT DOCUMENTS

WO WO 89/05477 6/1989

* cited by examiner

*Primary Examiner*—Fred J. Parker
(74) *Attorney, Agent, or Firm*—Mark G. Bocchetti

(57) ABSTRACT

A coating method and apparatus are taught for coating a liquid composition onto a surface of a moving web. A coating hopper for delivering the liquid composition to the surface of the moving web is provided with a rotatable backing roller. The moving web is wrapped around a portion of the rotatable backing roller with the rotatable backing roller supporting the moving web through a dynamic wetting line. The rotatable backing roller includes a plurality of circumferential grooves therein at a groove pitch of at least two per millimeter. An electrostatic field generated across the gap between the moving web and the liquid composition immediately prior to the dynamic wetting line. The method and apparatus permit either coating at a higher speed or higher viscosity than may be achieved in the prior art, or greatly reduced groove line nonuniformity at a given coating speed and viscosity.

12 Claims, 6 Drawing Sheets

SYSTEM FOR COATING USING A GROOVED BACKING ROLLER AND ELECTROSTATIC ASSIST

FIELD OF THE INVENTION

The invention relates generally to apparatus and methods for coating a liquid composition onto a moving substrate to form a coated layer thereon; and, more particularly, to coating apparatus and methods utilizing a backing roller while providing an electrostatic field at the dynamic wetting line where the coating liquid meets the moving substrate.

BACKGROUND OF THE INVENTION

In coating a liquid composition from a coating die, hopper, or similar coating device onto a first or "front" surface of a moving web substrate, it is well known in the coating art to precisely position and support the substrate by guiding the substrate around a rotating backing roller spaced apart from the coating device. The distance between the front surface of the web and the coating device is referred to as the "coating gap." The web is thus supported directly by the surface of the backing roller through a substantial angle of rotation, or "wrap," typically between about 90° and 180°.

The front and back surfaces of the moving web carry boundary layers of air, each of which can create different problems in achieving stable coatings at high coating speeds. In the prior art, the preferred solutions to these differing front and back surface problems can be mutually incompatible.

The boundary air layer on the back surface of the web is drawn into the entrance nip formed between the web and the backing roller, which in the older prior art is typically a smooth-surface roller. At lower conveyance speeds, for example, 0.5 m/s, the air is squeezed out at the nip by tension in the web, and the web is supported without slippage on the roller. However, as conveyance speed is increased, the boundary air is incompletely squeezed out and the web begins to float on a dynamic cushion of air between the web and the roller and thus traction between the web and roller diminishes. This can lead to at least three unwanted effects: the web may wander laterally on the roller, resulting in intermittent honing of the web back surface and coating off the edge of the web; the web may not turn synchronously with the backing roller, resulting in scratching or honing of the web back surface and irregularly variable web speed at the coating point; and the coating gap may be decreased irregularly and unacceptably by the air cushion, causing unpredictable and unacceptable thickness variations in the coating.

It is well known in the prior art to relieve the back side boundary air layer by providing any of various incuse patterns in the surface of the backing roller. These patterns may include, for example, a random surface comprising lands and incuse areas which may be varied in the percentage of surface area occupied by each (see for example U.S. Pat. No. 4,426,757 to Hourticolon, et al.). More commonly, an axially central portion the roller is circumferentially scribed with a pattern of shallow grooves. See, for example, U.S. Pat. No. 3,405,855 to Daly et al. and U.S. Pat. No. 4,428,724 to Levy. Such circumferential grooves are known in the photographic coating art as "microgrooves" and may take the form either of a plurality of truly circumferential closed grooves, each in a plane orthogonal to the roller axis, or of a single continuous spiral groove of appropriately shallow pitch. The performance of these two groove patterns is substantially equivalent. A pattern commonly in use in the coating of photographic products employs 1 groove per axial millimeter (gpmm) of roller surface, each groove being 0.3–0.6 mm wide at the roller surface and about 50 to 130 $\mu$m deep (see U.S. Pat. No. 6,177,141 to Billow, et al.). This pattern, provided over an axially central portion of a backing roller, can provide suitable traction and conveyance stability of a flexible plastic web substrate around a coating backing roller about 10 to 20 cm in diameter at linear speeds exceeding 5 m/s, unit area traction being substantially increased over that exhibited by a smooth roller despite the loss in roller surface area available for contact with the web.

The front surface boundary air layer can create a similar problem in engaging the coating composition as it is being applied from a hopper to the web surface. As coating speed is increased, a critical speed is encountered at which air begins to be entrained under the coating composition at the coating point, preventing the composition from wetting the web along a uniform line and thus unacceptably disrupting the uniformity of coating. It is well known in the coating art that imposing an electric field between the front surface of the web substrate and the hopper can raise significantly this critical speed for air entrainment (AE), for example, from about 2 m/s to about 6 m/s (see for example U.S. Pat. No. 4,837,045 to Nakajima). This technique is referred to as electrostatic assist for coating (ESA).

A serious problem can arise, however, in using ESA when coating onto a web supported by a grooved backing roller. A periodic coating thickness non-uniformity, referred to herein as groove lines, tends to form in the lower liquid layers as they are applied to the web, the lines being an image of the backing roller surface pattern. The electrostatic force generated on the coating composition is proportional to the square of the imposed electric field ($E^2$). Therefore, it follows that the magnitude of coating nonuniformity is proportional to any variation in $E^2$ occurring in the immediate vicinity of the lower surface of the coating composition as it is contacting the web. The electric field is inversely proportional to the dielectric gap between the roller surface and the front surface of the web understanding that over land areas of the roller, the gap is simply the thickness of the web, whereas in grooved areas, the gap includes the depth of the grooves. Thus there exists a pattern of periodic variation in electric field, and ESA, exerted on the coated fluid along the axial direction of the roller, creating a groove line pattern in the coating.

Multi-layer coating packs or composites having a relatively low bottom layer viscosity, for example, 4 centipoises (cP), are especially prone to formation of groove lines. As coating speed or viscosity is increased, the prevention of front-side air entrainment, even with a grooved coating backing roller, typically requires progressively higher voltages of ESA, which can, in turn, result in more intense groove lines in the coating. Thus, in the known art, grooving the backing roller to relieve the back side boundary layer problem is antithetical to increasing ESA voltage to relieve the front side boundary layer problem. The propensity to form groove lines is thus a serious impediment to achieving high coating speeds (in excess of 2 m/s) or high viscosity (in excess of 10 cP at $10^5$ reciprocal seconds) as may be desirable for increased productivity and coated uniformity.

Another approach to relieving the back side boundary layer problem is to use a nip roller to press the web against a smooth coating backing roller and squeeze out the air entrained between the web and the roller. This nip roller would be located prior to the coating application point. The use of a smooth backing roller would avoid creation of non-uniform ESA. However, this nip roller would need to contact the face side of the web immediately prior to coating. In many situations, it is desirable to avoid contact with the face side of the web until the last layer of coating has been applied and sufficiently dried. In addition, the use of a nip roller increases the chances of causing creasing, particularly with thinner webs.

In prior art practice, using a prior art backing roller having a pitch of 1 gpmm and a groove depth of 130 μm and a groove width of 500 μm, for a given web substrate having a given thickness and being coated at a given web speed, the level of ESA is adjusted until a very low but acceptable intensity of groove lines is achieved. Typically, the coating speed and the ESA level are co-optimized to achieve the maximum possible coating speed with the highest possible ESA voltage, which coating speed may be substantially less than that permitted solely by the traction afforded by the grooves. Coating speeds higher than this may be used only at a sacrifice in coating uniformity.

Thus there is a need for an improved coating apparatus and method which provides suitable web traction at high coating speeds (greater than 2 m/s) while simultaneously allowing high levels of ESA (greater than the ESA level provided by applying 300V of voltage differential between the surface of a coating backing roller and the application hopper) without causing unacceptable groove lines in coatings.

SUMMARY OF THE INVENTION

It is therefore an object of the present invention to provide an improved backing roller which permits stable coatings of acceptable thickness uniformity to be made at high coating speeds in the presence of high levels of ESA.

It is a further object of the present invention to provide a method for preventing unacceptable levels of groove line non-uniformity when using ESA in the presence of a grooved backing roller.

Briefly stated, the foregoing and numerous other features, objects and advantages of the present invention will become readily apparent upon a review of the detailed description, claims and drawings set forth herein. These features, objects and advantages are accomplished by providing a coating apparatus with a backing roller having a significantly higher spatial frequency of circumferential grooves, preferably at least about 2 grooves per millimeter (gpmm), than that of prior art backing rollers having 1 groove per axial millimeter of roller surface. Preferably, the grooves are significantly shallower than prior art grooves (a depth of about 75 to 150 μm), and most preferably having a depth of about 45 μm. The finer, shallower groove pattern reduces axial spatial variations in ESA force by as much as a factor of 10 or more by decreasing the axial distance between lands and by decreasing the depth of the grooves. It is believed that such axial spatial variations along the roller surface give rise to an irregular or scalloped dynamic wetting line where the liquid composition meets the web surface; and further, that the magnitude of groove line non-uniformity is directly proportional to the magnitude of deflection of the wetting line, and further, that the magnitude of deflection is directly proportional to the square of the wavelength of the deflection. Thus, increasing the groove frequency, or "pitch," by a factor of two (from 1 to at least 2 gpmm) can reduce the magnitude of groove line non-uniformity by a factor of at least 4. In a preferred embodiment, a backing roller has a groove pitch of 4 gpmm, a groove depth of 45 μm, and a groove width of 200 μm, providing a non-uniformity reduction of about 160× over a prior art roller having a pitch of 1 gpmm, a groove depth of 130 μm, and a groove width of 500 μm. Furthermore, the grooved pattern of the preferred embodiment extends across the axial length of the backing roller so as to completely underlie the full width of the coating composition.

By modifying the groove depth, the conveyance performance of the backing roller with finer groove patterns is comparable to that of backing rollers with prior art groove patterns. At linear speeds up to at least 7.5 m/s, with web tension at about 0.75 pounds-force per lateral inch of web, a 10 cm diameter backing roller having a groove frequency of 4 gpmm, a groove depth of about 45 μm, and a groove width of about 200 μm, has been found to provide conveyance performance substantially the same as that of a 1 gpmm roller having a groove depth of about 130 μm and a groove width of about 500 μm.

In the practice of the method of the present invention, a groove pitch and depth are provided in a backing roller which reduces the intensity of groove lines in the coating to an acceptable level and provides adequate conveyance performance, and then a level of ESA is determined empirically which prevents air entrainment of a given composition when coated onto a web of given thickness at a desired coating speed. This permits either coating at a higher speed or higher viscosity than may be achieved using the above-described prior art method with a prior art backing roller, or greatly reduced groove line nonuniformity at a given coating speed and viscosity.

It should be appreciated by those skilled in the art that the magnitude of groove line nonuniformity that is acceptable depends on many factors, including the type of product being manufactured, and photographic products have a relatively low tolerance for groove line nonuniformity. Even within the field of photographic products, the acceptable magnitude can vary by more than ten fold, where products that are magnified greatly or products with a relatively high contrast have the tightest tolerances.

DETAILED DESCRIPTION OF THE INVENTION

Figure 1A:
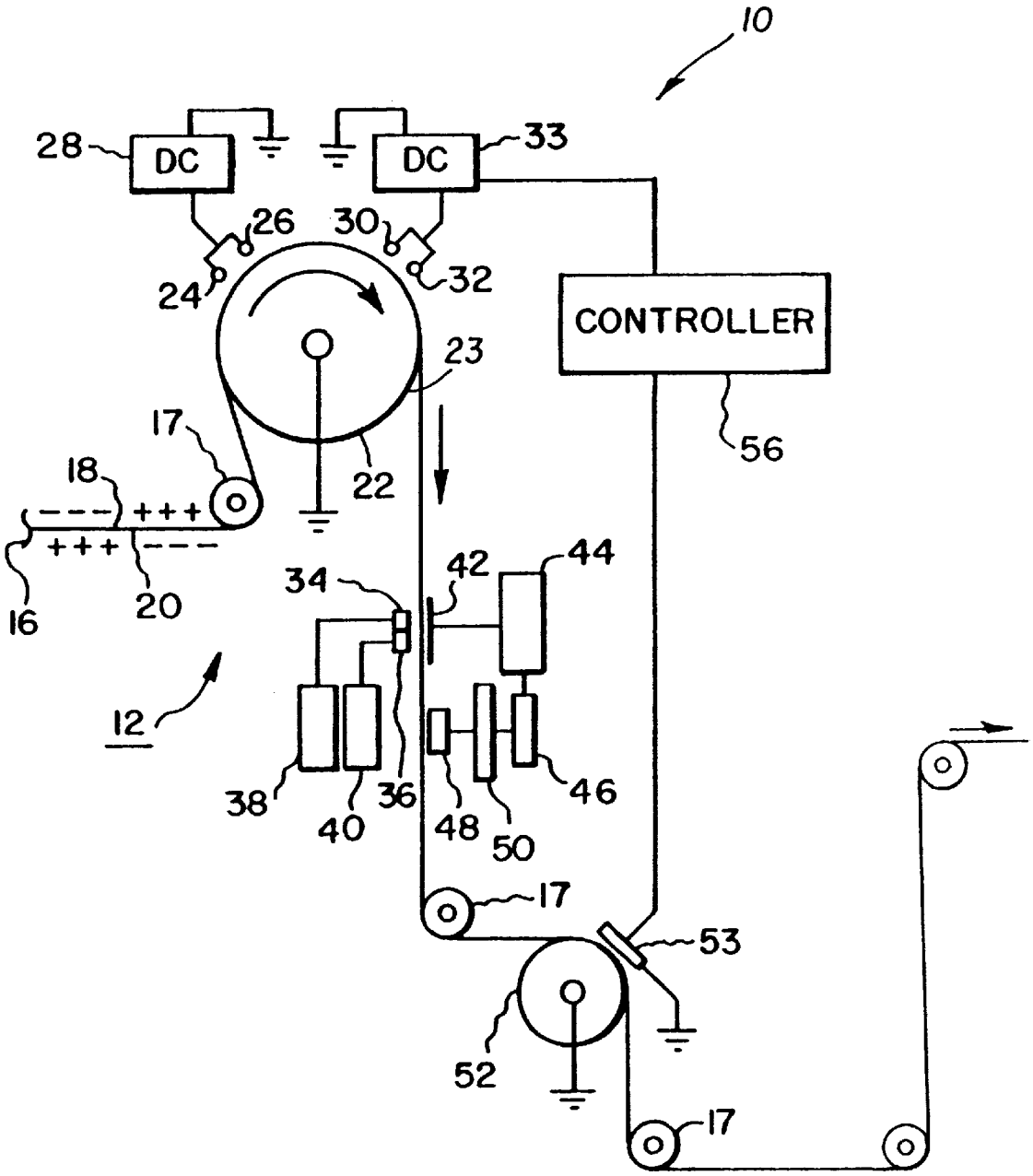
FIGS. 1A and 1B are a schematic of an apparatus that can be used to practice the method of the present invention.
Figure 1B:
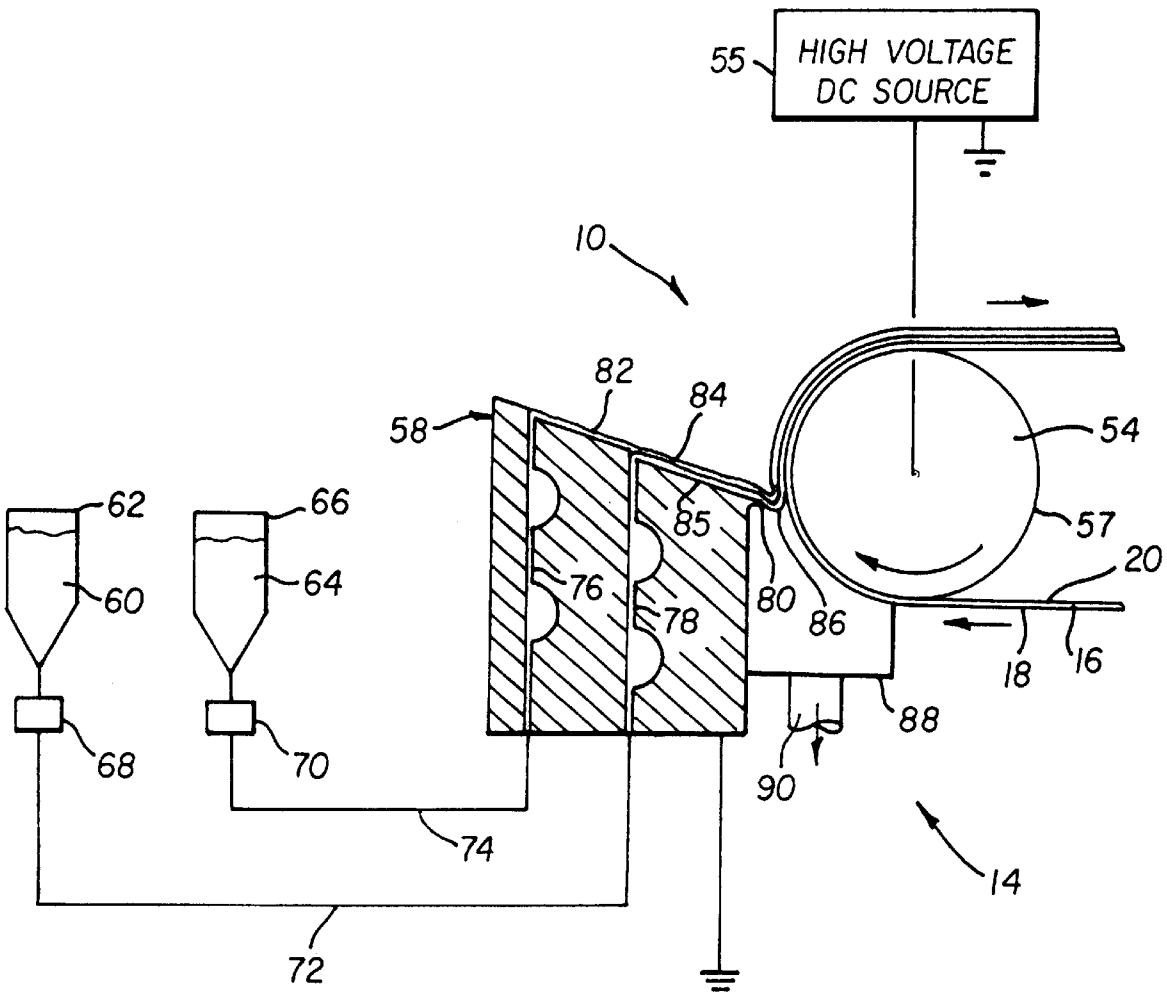

Turning first to FIGS. 1A and 1B, there are shown schematics of an apparatus 10 that can be used to practice the method of the present invention. Electrostatic coating assist may be provided by section 12 without electrification of section 14, or by electrification of section 14 without installation or use of section 12, or preferably by use of sections 12 and 14 together, as described below. The common element among these methods and apparatus configurations is the generation of an electrostatic field in the air gap between the coating bead and the web just prior to the coating point (more accurately described as the dynamic wetting line) as will be described hereinafter in greater detail. This may be achieved, although not necessarily with equal quality results, by either a) electrifying the web ahead of the coating point so that the web carries a charge into section 14; or b) by electrifying the coating apparatus in section 14 to provide the desired field at the coating point; or, c) by a combination of a) and b). Preferably, a voltage differential greater than about 300 volts is used to generate the electrostatic field in the air gap between the coating bead and the web just prior to the coating point. In a preferred embodiment, described in detail below, the web is first electrified and then completely neutralized in section 12, so that the field providing electrostatic assist for coating derives only from the electrification in section 14.

In a presently preferred embodiment, a continuous web 16 having first and second surfaces 18, 20, is supplied to section 12 from a conventional unwinding and conveyance apparatus (not shown) and may be conveyed conventionally through the apparatus on generic rollers 17. Web 16 may be formed of any substantially non-conductive material including, but not limited to, plastic film, paper, resin-coated paper, and synthetic paper. Examples of the material of the plastic film are polyolefins such as polyethylene and polypropylene; vinyl copolymers such as polyvinyl acetate, polyvinyl chloride, and polystyrene; polyamide such as 6,6-nylon and 6-nylon; polyesters such as polyethylene terephthalate, and polyethylene-2 and -6 naphthalate; polycarbonate; and cellulose acetates such as cellulose diacetate and cellulose triacetate. The web may carry one or more coats of subbing material on one or both surfaces. The subbing material may contain one or more surfactant components so as to enhance the coating uniformity of the subbing material and to improve the coatability of the layer or layers to be coated on top of the subbing material. The resin employed for resin-coated paper is typically a polyolefin such as polyethylene.

Web 16 may have patches of electrostatic charges disposed randomly over one or both surfaces 18, 20. In Section 12, charges on the web are adjusted. When section 14 is not electrified, the web in section 12 is provided with a residual charge of at least about 300 volts as measured by induction probe 53 at the exit of section 12. Various methods and apparatus known in the art, including but not limited to those disclosed in the patents recited hereinabove, may be suitable for charge modification in section 12 in accordance with the invention.

In an embodiment presently preferred for both plastic and paper webs, both sections 12 and 14 are provided, section 12 being used as follows. Web 16 is wrapped and conveyed around a grounded, conductive backing roller 22 with web surface 20 in intimate contact with the conductive surface 23 of roller 22. Web surface 18 is exposed to negatively charged electrodes 24, 26 which "flood" a large amount of negatively charged particles onto surface 18. Electrodes 24, 26 may be electrically connected to the negative terminal of an adjustable 0–20 kV, 0–15 mA source 28 of DC potential. Grounded roller 22 acts as a counter electrode for electrodes 24, 26.

As web 16 is advanced along roller 22, it moves beneath electrodes 30, 32 which may be electrically connected to the positive terminal of a DC potential source 33 similar to source 28. Electrodes 30, 32 deposit a large amount of positively charged particles onto web surface 18 which neutralize the negative charge previously imparted to this surface by electrodes 24, 26. Grounded roller 22 functions as a counter electrode for electrodes 30, 32.

It will be understood by those skilled in the art that the polarity of electrodes 24, 26 and 30, 32 may be reversed such that web surface 18 is "flooded" first with a large amount of positive charges and subsequently neutralized with a large amount of negative charges.

Web 16 is further conveyed about grounded roller 52 so that web surface 20 is in intimate contact with roller 52, the opposing web surface 18 being exposed to an induction probe 53 of a feedback control system comprising probe 53 and controller 56, which controller is responsive to the level of charge sensed by probe 53 and may be programmed to automatically adjust the level of charge applied by DC source 33 to electrodes 30, 32 to control the steady-state residual charge on surface 18 at any desired value. When section 14 is being electrified in addition to section 12 in accordance with the preferred embodiment of the invention, controller 56 is programmed to provide a residual voltage at probe 53 near or at zero.

The just-described electrostatic web treatment typically is sufficient to completely discharge all charges on surface 18 of the web and some of the charge on surface 20. However, some webs may retain some residual charge on surface 20 which may also be removed.

After leaving roller 22, web 16 may be conveyed past two fixed voltage or fixed DC current ionizers 34, 36 which are mounted near and facing surface 20 of web 16 on a free span of travel. The ionizers 34, 36 are mounted so that the central axis of each ionizer is oriented parallel to the web and transverse to the direction of travel of the web. Each ionizer is electrically connected to a separate DC high voltage power supply 38, 40. A conductive plate 42 which is electrically isolated from ground is positioned opposite ionizers 34, 36 and facing surface 18 of web 16. Plate 42 can be of various shapes, designs, constructions, or materials, including both solid materials and screens, but plate 42 must incorporate at least a layer of conductive material to act as an equipotential surface to attract charge from ionizers 34, 36. A controllable bipolar high voltage source 44 is electrically coupled to plate 42 to deliver voltage to the plate over a wide range of positive and negative voltages (±/−5 kV). A feedback control system 46 may have a sensor or sensor array 48 responsive to the mean charge density residual on the web after treatment by the ionizers. Source 44 may be adjusted manually to adjust the voltage level on plate 42 so that the plate voltage increases in the same polarity as a direct function of the residual charge density on the web; preferably, such adjustment is controlled automatically by electronic controller 50 to minimize the steady-state residual free charge on the web, preferably near or at zero.

Figure 2:
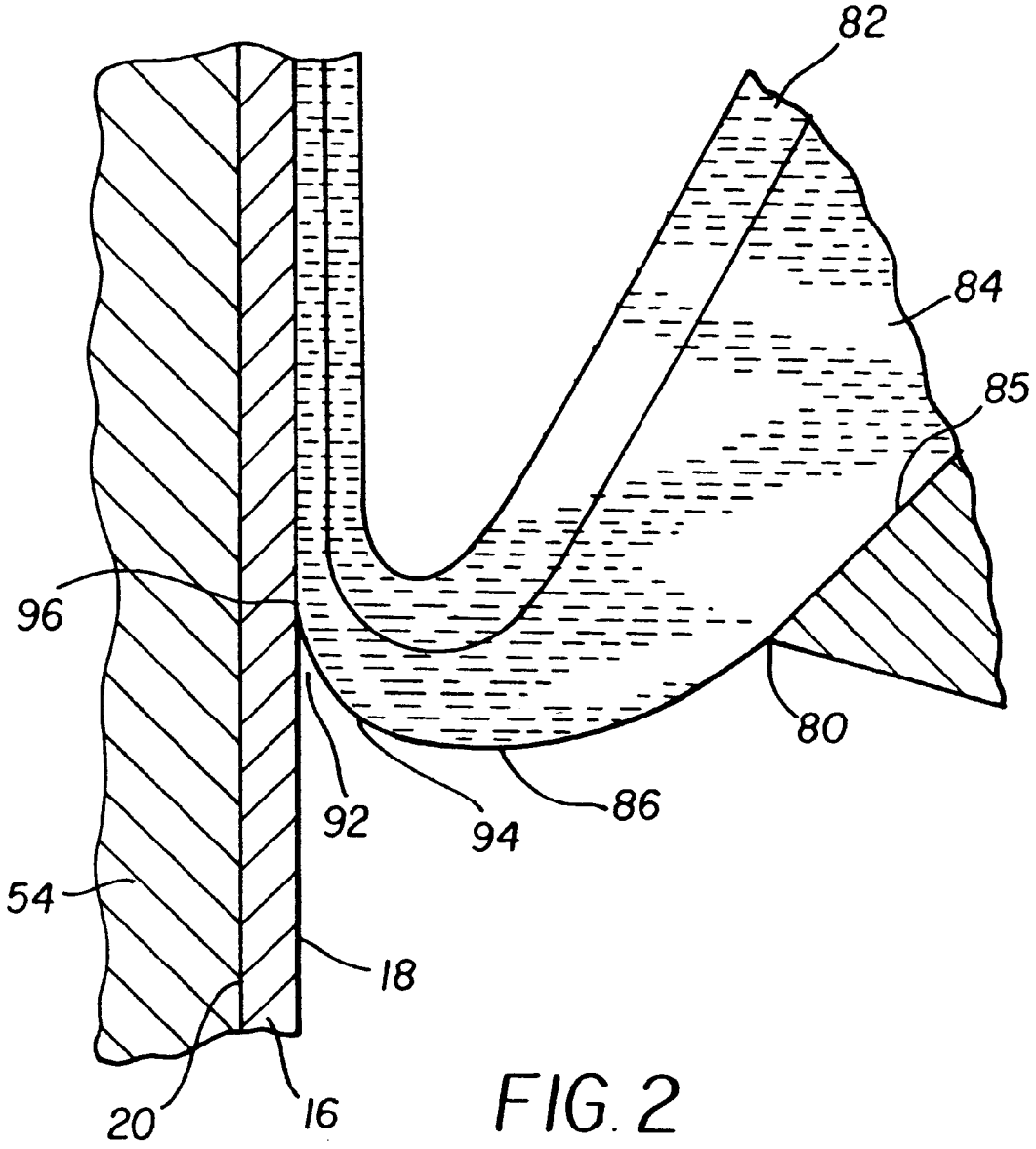
FIG. 2 is an enlarged view of the coating bead formed in the gap between the hopper lip and the web supported on the backing roller.

As shown in FIG. 1B, in section 14 web 16 is entered upon and wrapped partially around a backing roller 54, the angle of wrap including a coating point 96 (actually a coating line. See FIG. 2.). Roller 54 is preferably electrically isolated and may be electrically connected to a high voltage DC source 55 to place a high potential on the surface 57 of backing roller 54, for example, 300 V, creating a standing electric field around roller 54. Slide bead coater 58 is electrically grounded. Slide bead coater 58 can simultaneously apply one or more coating composition layers to the moving web 16. For simplicity, the exemplary slide bead coater 58 depicted shows only the application of two coating layers. There is a first coating composition 60 in a first supply vessel 62 and a second coating composition 64 in a second supply vessel 66. First and second delivery systems 68, 70 regulate the flow of the liquid compositions 60, 64 from the vessels 62, 66 through first and second delivery lines 72, 74 to first and second distribution passageways 76, 78 of a slide hopper 58. Web substrate 16 is conveyed on a surface 20 thereof around a backing roller 54. Slide bead coater 58 is provided with a lip 80, and backing roller 54 and lip 80 are positioned to form a gap therebetween. Composition 64 is superposed as a layer 82 on layer 84 formed by composition 60 by slide hopper 58 to form a liquid two-layer composite. The two-layer composite flows under gravity down hopper slide surface 85, over lip 80, and onto surface 18 of web 16, forming a continuous, dynamic, hydraulic bead 86 bridging the gap between lip 80 and web 16 (shown in an enlarged view in FIG. 2). The bead 86 is stabilized by application of suction (vacuum pressure) to the underside of the bead 86 in a close-fitting vacuum box 88 connected to a regulatable vacuum source via conduit 90.

An electrostatic field is created between the coating layers 82, 84 and surface 18 of web 16 at the coating point via deposition of charge uniformly on surface 18, preferably with an electric potential between 300 volts and 2000 volts, the polarity of which may be either positive or negative. This charge may be deposited on the web either by sections 12 or 14 as described above, or by any of several known apparatus and methods, for example, as disclosed in PCT International Publication No. WO 89/05477. In the preferred embodiment, an electrostatic field is created between the coating layers 82, 84 and surface 18 of web 16 at the coating point by establishing a potential difference between the hopper lip 80 and the backing roller 54. The electrostatic field in the gap 92 between the bead 86 and the surface 18 of the web 16 yields an electrostatic force acting on the lower surface 94 of the bead 86 proximate to the dynamic wetting line 96. This electrostatic force acting on the lower surface 94 of the bead 86 is the electrostatic assist to the coating operation.

At the dynamic wetting line 96 (sometimes referred to herein as the coating point) the surface 18 must be substantially non-conductive to allow sufficient electrostatic field strength between surface 18 and bead 86. By substantially non-conductive it is meant that the characteristic electrical length $\lambda$ should be less than about 400 $\mu$m, preferably less than 100 $\mu$m, where $\lambda$ is defined as by the relationship $$\lambda=[\rho_S CU]^{-1}$$

where $\rho_s$ is the web surface resistance on the side to be coated (ohms/square), C is the web capacitance per unit area while on the coating roller (F/m$^2$), and U is the web speed (m/s) as discussed in U.S. Pat. No. 6,171,658 to Zaretsky, et al.

The surface 18 may be of higher or lower resistivity (shorter or longer characteristic electrical length) at points other than the coating point. The surface 20 preferably has a surface resistivity greater than about $10^6$ ohm per square to facilitate electrical isolation of the coating roller from neighboring rollers in contact with surface 20. The surface 20 preferably has a surface resistivity less than about $10^9$ ohm per square to reduce non-uniformity of the electrostatic field due to incomplete contact of surface 20 with the coating roller 54. The present invention relaxes this upper bound on the surface resistivity of surface 20.

Figure 3:
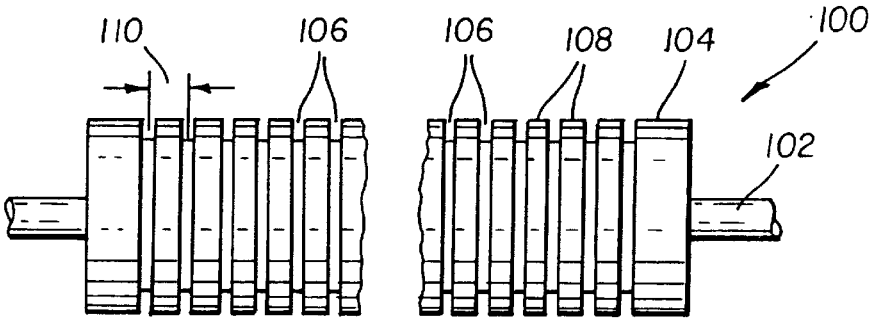
FIG. 3 (prior art)
FIG. 3 is a front elevational view of a prior art backing roller.

Referring to FIG. 3, a prior art backing roller 100 is shown which was used in the coating apparatus 10 of FIG. 1. Prior art backing roller 100 includes an axial shaft 102 for mounting the roller into a coating apparatus in known fashion. The outer surface 104 of roller 100 is incised by a plurality of regularly spaced grooves 106 over a portion of the axial length of the roller 100 such that the surface 104 comprises alternating grooves 106 and lands 108, the lands 108 being unmodified areas of surface 104. When roller 100 is used to rotatably support a moving web substrate past a coating point, the back side boundary layer of air being carried by the web is compressed by contact with the roller 100 and is dispersed into grooves 106, thus increasing traction of the web on lands 108 in known fashion. In the known art, the axial frequency (pitch) 110 of grooves 106 in a coating backing roller is about 1 per mm (24 per inch), the depth of each groove below surface 104 is from about 75 to about 130 $\mu$m, and the groove width is from about 375 to about 500 $\mu$m.

Figure 4A:
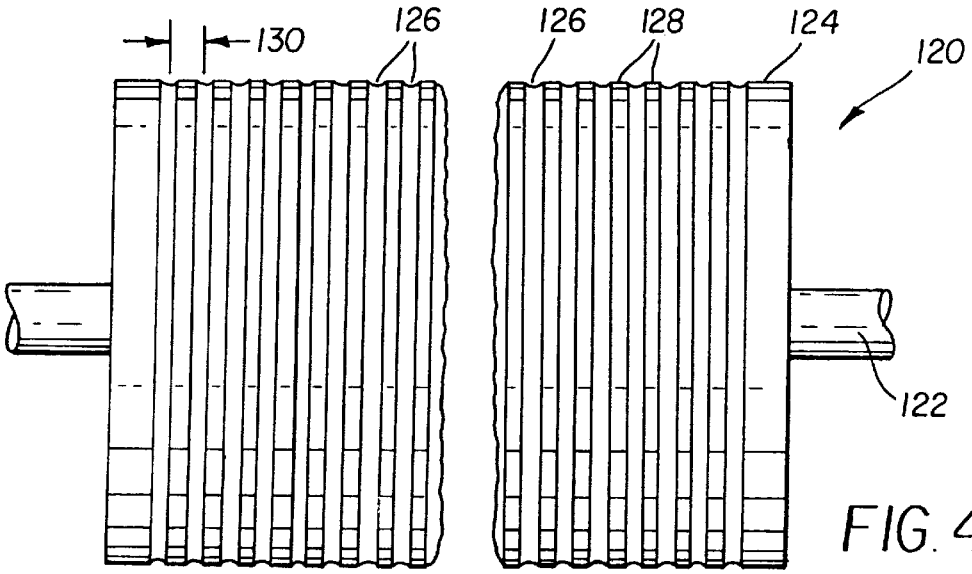
FIG. 4A is a front elevational view of a backing roller for use in the practice of the method and apparatus of the present invention.
Figure 4B:
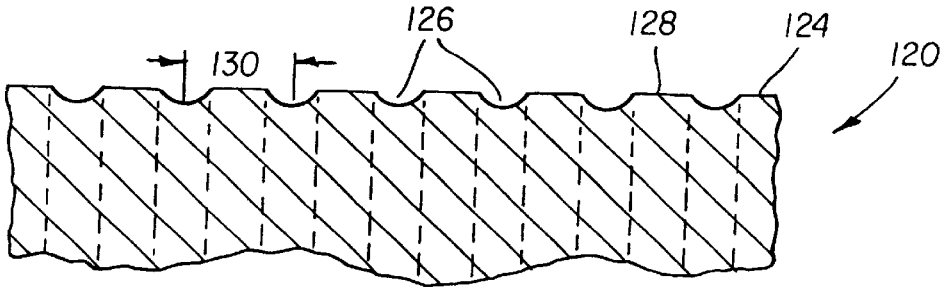
FIG. 4B is an enlarged view of FIG. 4A more clearly illustrating the groove pattern.

Referring to FIGS. 4A and 4B, an improved coating backing roller 120 in accordance with the present invention is similar in overall appearance to prior art backing roller 100. Backing roller 120 includes an axial shaft 122 for mounting the roller 120 into a coating apparatus such depicted in FIG. 1B. The outer surface 124 of roller 120 is incised by a plurality of regularly spaced grooves 126 over a portion of the axial length of the roller 120 such that the surface 124 comprises alternating grooves 126 and lands 128, the lands 128 being unmodified areas of surface 124. The circumferential grooves 126 are disposed over a portion of the surface 124 of the roller 120. Preferably, grooves 126 are provided over the entire axial portion of the roller 120 underlying the portion of the web or substrate to be coated with coating composition, as described below. Roller 120 differs from roller 100, first, in that the groove pitch 130 is at least about 2 gpmm and may be as high as about 8 gpmm or higher. Preferably, the groove pitch 130 is about 4 gpmm. Second, the grooves 126 are substantially shallower, being from about 20 $\mu$m to about 80 $\mu$m in depth from surface 124; preferably, the groove depth is about 45 $\mu$m. Grooves 126 are preferably arcuate in cross-section as shown in FIG. 4B. However, grooves 126 may have other cross-sectional shapes such as, for example, rectangular or V-shaped.

Roller 120 may be incorporated conventionally as a web backing roller in any desired apparatus for coating a liquid composition onto a moving web or substrate by any coating means wherein the web is supported for coating by a backing roller, including but not limited to bead coating, curtain coating, extrusion coating, and gravure coating. In the practice of the present invention, the coating apparatus (such as exemplary coating apparatus 10) is provided with means for inducing a voltage differential between the surface of the coating backing roller and the front side of the web substrate to be coated. This may be accomplished either by applying a voltage to the backing roller, or by electrifying the web ahead of the coating point to leave a residual charge thereupon, as discussed above.

No matter which of the above-described charging means is employed, the feature of interest is the electrostatic force exerted on the lower surface of the coating liquid in the vicinity of the coating application or wetting line, and the lateral uniformity of the electrostatic force. If the electrostatic force is highly uniform along the length of the application line, then the application itself will be highly uniform, resulting in a uniform coating. To the degree that there is a force variation along the application line, there will be some degree of variation in the application or wetting line, resulting in a variation in the thickness of the coating as measured in the crossweb direction.

In photographic coatings, such variation can manifest itself as variation in optical density across the width of the coating, which may be quantified by scanning with an optical densitometer. The output of such a densitometer typically is expressed as optical density, as is well known in the photographic art. The root mean square (RMS) variation in density across the width of the coating is a meaningful and useful expression of variation in coating thickness uniformity.

As described above, the electrostatic force generated on the coating composition is proportional to the square of the imposed electric field ($E^2$). The electric field presented on the lower surface of the coating composition is also inversely proportional to the dielectric gap between the roller surface and the front surface of the web. That is, over land areas of the roller, the thickness of the gap is simply the thickness of the web, whereas in grooved areas, the gap includes the depth of the groove. Further, as a result of electrostatic field solutions to Laplace's equation for a spatially periodic grooved pattern, the variation in electric field and force decays exponentially with distance above the backing roller surface. This exponential decay is a function of the spatial periodicity of the grooves, with shorter spatial wavelengths (higher pitch) exhibiting a faster decay, resulting in an enhanced smoothing of the force variation. Such smoothing action is enhanced by a backing roller in accordance with the invention wherein the groove pitch is at least 2 gpmm. Force variations are also reduced in such a roller because the groove depth is relatively shallow, preferably being about 45 $\mu$m.

Figure 5:
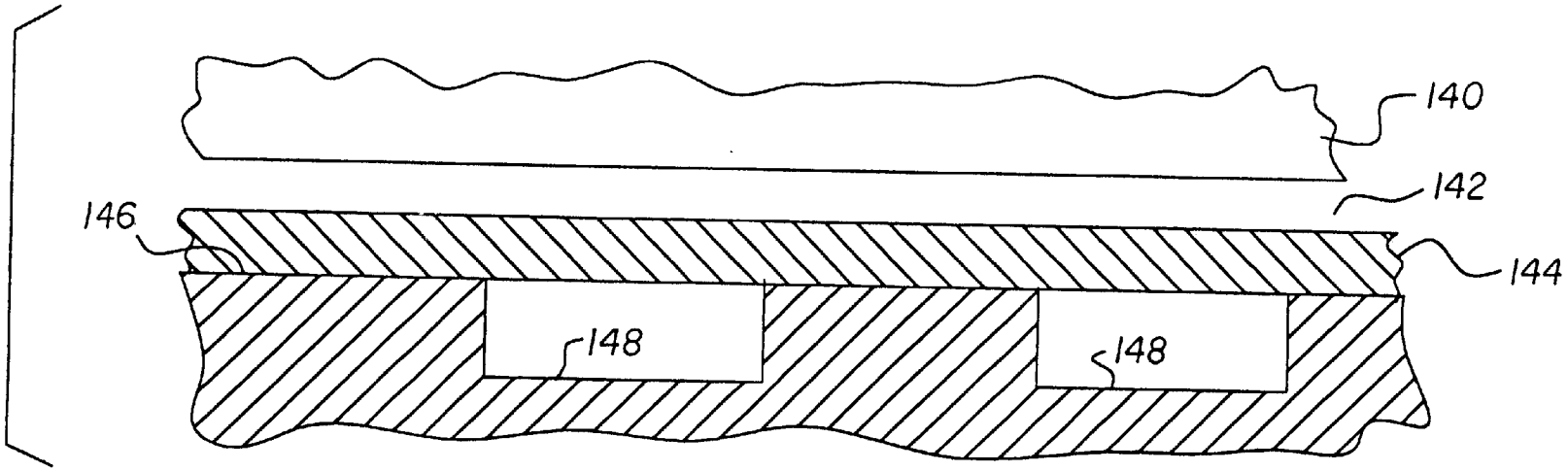
FIG. 5 is a rear elevational/partial sectional view looking in the machine direction from behind the liquid curtain of the coating liquid approaching the web which is supported on a roller having a grooved relief pattern illustrating the model geometry used for solving the electrostatic field problem.

The normalized electrostatic force per unit area difference $F_{dif}$, representing the electrostatic force variation over a relieved and non-relieved portion of the surface pattern, for example, between the grooves and land areas, can be calculated with an electrostatic field solver employing such methods as boundary element, finite element or finite difference. For the purposes of the present invention, the electrostatic stress variation was calculated using a finite difference model. As shown in FIG. 5, this model has the coating liquid 140 as an upper electrode at ground potential, an air gap 142 of constant thickness (for this calculation we look at the location where the liquid 140 approaches the web 144 and the gap therebetween is 30 $\mu$m), and then the web to be coated with its associated thickness, permittivity and incoming surface charges. Below the web 144 lies the coating roller surface 146, taken to be an equipotential at either ground or some non-zero potential. For purposes of this model, an equipotential of 1000V was assumed. Between the web 144 and the coating roller surface 146 is an air gap of varying thickness created by grooves 148 consistent with the geometry of the relief pattern.

The electrostatic stress (force/area) experienced by the coating liquid is computed using the following equation;

$$F = \frac{1}{2}\varepsilon_o E^2 \tag{1}$$

where $\epsilon_o$ is the permittivity of free space and equals 8.854E-12 farads/m, and E is the electric field experienced by the liquid in units of volts/$\mu$m. This force/area will be a maximum, $F_{max}$, over the non-relieved portion of the surface pattern and will be a minimum, $F_{min}$, over the relieved portion. The difference between the maximum and the minimum force/area is normalized to the stress $F_{norm}$ experienced by the electrodes of a parallel plate, an air gap capacitor having a combination of applied voltage and plate separation such that an electric field $E_{norm}$ of 10 volts/$\mu$m is produced;

$$F_{norm} = \frac{1}{2}\varepsilon_o E_{norm}^2 \tag{2}$$

Therefore, the normalized electric force/area difference $F_{dif}$ is computed as $$F_{dif} = \frac{F_{\max} - F_{\min}}{F_{norm}} \tag{3}$$

The coated thickness non-uniformity is calculated from coated samples and is expressed as a change in coated thickness from the nominal or average thickness. It may represent the local change in thickness of the entire liquid coating or perhaps a single layer of interest within a multilayer coating. In the case of periodic or pseudo-random patterns, performing these calculations in the frequency domain can improve signal-to-noise. The coated thickness non-uniformnity is converted from spatial coordinates to frequency coordinates through the use of Fourier or similar analysis. The power-spectral-density (PSD) is then calculated and integrated over those frequencies produced by the relieved surface pattern that dominate in determining the normalized electrostatic force/area difference $F_{dif}$.

Figure 6:
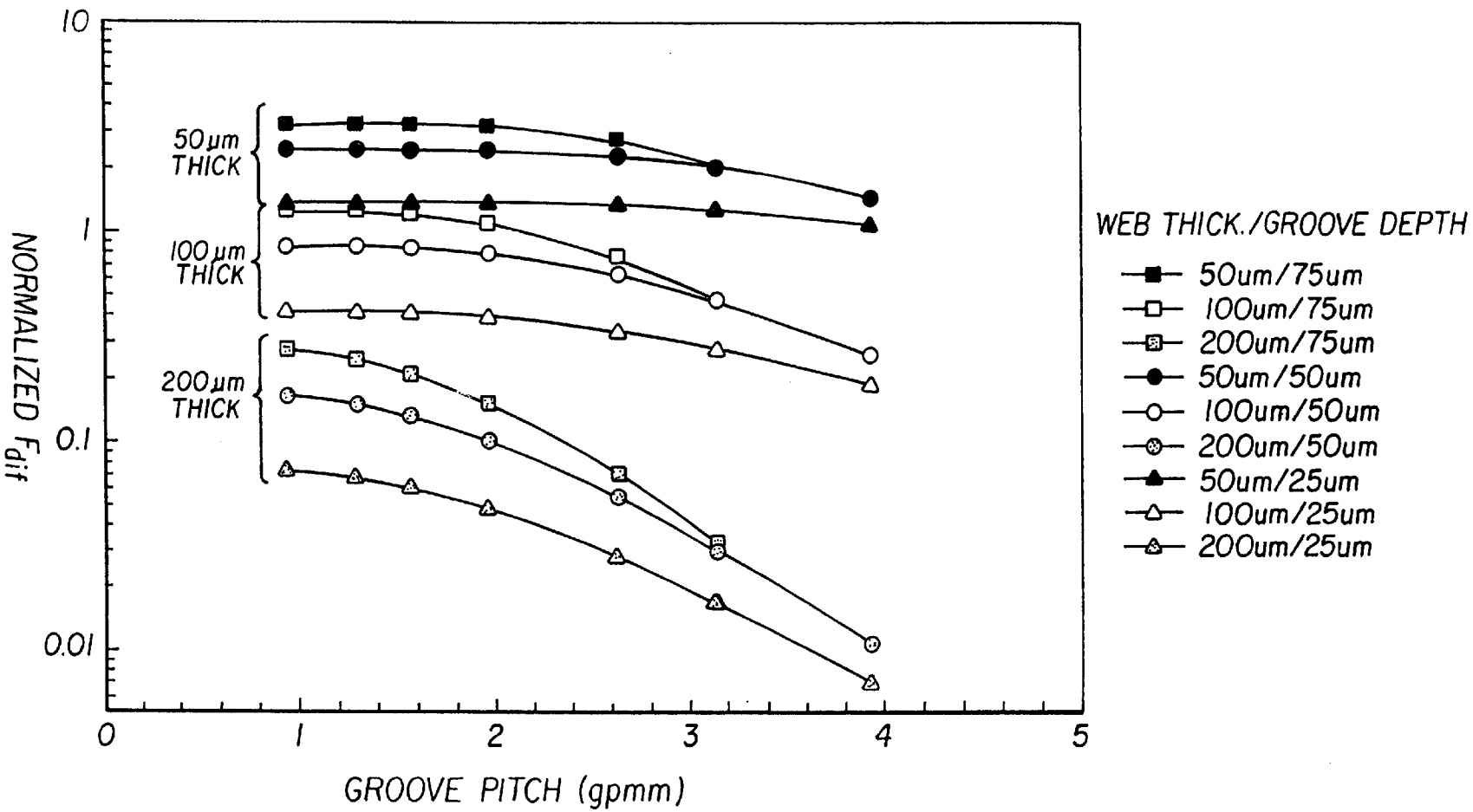
FIG. 6 is a graph showing normalized electrostatic force per unit area difference ($F_{dif}$) curves as a function of groove pitch, groove depth, and web thickness, as calculated from a model using the geometry provided in FIG. 5.

The smoothing action due to higher pitch, and reduction in force variation due to shallower groove depth, is demonstrated in FIG. 6, a graph of the normalized electrostatic force per unit area difference $F_{dif}$, plotted as a function of groove pitch for a variety of web thicknesses and groove depths. As can be observed in FIG. 6, $F_{dif}$ decreases with increasing groove pitch. The groove pitch at which the curves begin to roll-off is a function of the web thicknesses, with thicker supports showing a roll-off at lower groove pitch. Based on these results, a reasonable nominal value for this roll-off is about 2 gpmm.

The relationship between groove pitch and web thickness for determining the roll-off point may be reasonably estimated using the exponential decay function mentioned earlier, $$F_{dif} \alpha\ e^{-kx} \tag{4}$$

where the symbol a means "proportional to", k is the spatial number, computed from k=2πp, p is the pitch in gpmm, and x is the radial distance away from the surface of the backing roller with x=0 being defined as the surface of the land area. The roll-off point for various combinations of groove pitch and thickness may be estimated by maintaining the exponent in equation 4 to be constant. Therefore, when comparing two different cases, one with a backing roller having a groove pitch $p_1$, a web thickness $t_1$ and a permittivity $\epsilon_1$,, the second with a backing roller having pitch $p_2$, a web thickness $t_2$ and permittivity $\epsilon_2$, one can estimate the relationship between groove pitches $p_2$ and $p_1$ to produce an equivalent roll-off in $F_{dif}$ as follows, given a difference in thickness $t_2$ vs. $t_1$, $$\frac{p_2}{p_1} = \frac{\dfrac{t_1}{\varepsilon_1/\varepsilon_o} + \beta}{\dfrac{t_2}{\varepsilon_2/\varepsilon_o} + \beta} \tag{5}$$

where β is the air gap thickness between the upper surface of the web and the lower surface of the coating liquid, taken to be 30 μm for these calculations. It is believed that the coating non-uniformity is proportional to the deflection of the wetting line in response to the electrostatic force variations. Therefore, increasing the pitch will reduce the groove line non-uniformity in two ways; the first is a reduction in electrostatic force variation (enhanced by a reduction in groove depth), and the second is a reduction in wetting line deflection arising from the smaller radius of curvature. For example, increasing the pitch from 1 gpmm to 4 gpmm, in conjunction with a decrease in groove depth from 130 μm to 45 μm, provides a reduction in electrostatic force variation by roughly a factor of 10. Simple geometry suggests that the deflection of the wetting line goes as the inverse of the pitch squared. For the 4× increase in pitch in this example, there is a factor of $4^2$=16× reduction in wetting line deflection. The net effect is the product of the two, resulting in a factor of 160 reduction in coating non-uniformity.

The method and apparatus of the present invention are especially useful in the coating of web substrates between about 20 μm and about 300 μm in thickness, at ESA levels comparable to those achieved by creating a voltage differential between the coating backing roller and the hopper between about 300 volts and about 2000 volts.

The improvement in coating uniformity afforded by coating in accordance with the present invention is shown by the following examples.

EXAMPLE 1

A two-layer coating pack was formed of aqueous gelatin emulsions, the bottom layer containing carbon black to provide optical density. The top layer contained 13% gelatin and a surfactant and exhibited a viscosity of 40 cP. Three variants of the bottom layer contained 4.5%, 10.5%, and 16.0% gelatin and exhibited viscosities of 4.6 cP, 22 cP, and 89 cP, respectively. Bead coatings were made at 2.5 m/s onto a polyester web substrate subbed on both sides with a surface resistivity of about $10^{13}$ ohm per square at relative humidity of 50% and having a thickness of 100 μm. The space between the hopper lip and the outer surface of the web was 250 μm. Hopper suction was between 50 and 100 Pascals. The bottom layer coating thickness was 24 μm and the total coating thickness was 61 μm. Each variant pack was coated using coating backing rollers having a groove pitch of 1 gpmm, groove depth of 130 μm, and a groove width of 500 μm (prior art) and 4 gpmm, groove depth of 45 μm, and a groove width of 200 μm (present invention) at electrostatic assist levels of 400 volts and 1000 volts.

Results, expressed as RMS% optical density differences across the groove patterns in the coatings, show that at both voltage levels and for each formulary variant, the coating non-uniformity was reduced by several orders of magnitude by using a 4 gpmm backing roller instead of a 1 gpmm backing roller.

TABLE 1

| | 400 volts | | 1000 volts | |
|---|---|---|---|---|
| | 1 gpmm | 4 gpmm | 1 gpmm | 4 gpmm |
| 4.6 cP | 1.396 | <0.006 | 2.366 | <0.005 |
| 22 cP | 8.700 | 0.229 | 6.748 | 0.054 |
| 89 cP | No data | No data | 8.224 | 0.163 |

EXAMPLE 2

A two-layer coating pack was formed of aqueous gelatin emulsions, the bottom layer containing carbon black to provide optical density. The top layer contained 12% gelatin and a surfactant and exhibited a viscosity of 30 cP. The bottom layer contained 3% gelatin with a shear-thinning thickening agent and exhibited a viscosity of 17 cP at a shear rate of 100 $sec^{-1}$. Bead coatings were made at 2.5 mls onto a polyester web substrate subbed on both sides with a surface resistivity of about $10^{13}$ ohm per square at relative humidity of 50% and having a thickness of 100 μm. The space between the hopper lip and the outer surface of the web was 250 μm. Hopper suction was 100 Pascals. The bottom layer coating thickness was 13 μm and the total coating thickness was 48 μm. The coating pack was coated using coating backing rollers having a groove pitch of 1 gpmm, groove depth of 130 μm, groove width of 500 μm (prior art) and 3 gpmm, groove depth of 58 μm, groove width of 240 μm (present invention) and 4 gpmm, groove depth of 45 μm, groove width of 200 μm (present invention) at electrostatic assist levels of 400 volts and 1000 volts.

Results, expressed as RMS% optical density differences across the groove patterns in the coatings, show that at both voltage levels the coating non-uniformity was greatly reduced by using backing rollers in accordance with the invention.

TABLE 2

| | 1 gpmm | 3 gpmm | 4 gpmm |
|---|---|---|---|
| 400 volts | 5.10 | 0.173 | 0.032 |
| 1000 volts | 4.25 | 0.344 | 0.139 |

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in an illuminating sense.

PARTS LIST

10 apparatus
12 section
14 section
16 web
18 first web surface
20 second web surface
22 grounded, conductive backing roller
23 conductive surface
24 negatively charged electrode
26 negatively charged electrode
28 DC source
30 positively charged electrode
32 positively charged electrode
33 DC source
34 DC current ionizers
36 DC current ionizers
38 DC high voltage power supply
40 DC high voltage power supply
42 conductive plate
44 controllable bipolar high voltage source
46 feed back control system

48 sensor array
50 electronic controller
52 grounded roller
53 induction probe
54 backing roller
54 DC high voltage power source
56 controller
57 surface
58 slide bead coater
60 first coating composition
62 first supply vessel
64 second coating composition
66 second supply vessel
68 first delivery system
70 second delivery system
72 first delivery line
74 second delivery line
76 first distribution passageway
78 second distribution passageway
80 lip
82 layer
84 layer
85 hopper slide surface
86 hydraulic bead
88 close-fitting vacuum box
90 conduit
92 gap
94 lower surface
96 coating point
100 prior art backing roller
102 axial shaft
104 outer surface
106 grooves
108 lands
110 axial frequency/pitch
120 improved backing roller
122 axial shaft
124 outer surface
126 grooves
128 lands
130 groove pitch
140 coating liquid
142 air gap of constant thickness
144 web
146 roller surface
148 groves

What is claimed is:

1. A method for coating a liquid composition from an applicator to a moving web comprising the steps of:

(a) conveying the moving web along a path to wrap around a portion of a backing roller, the backing roller having a plurality of circumferential grooves therein at a groove pitch of at least two per millimeter;

(b) delivering the liquid composition from the applicator to a surface of the moving web at a dynamic wetting line while the moving web is supported on the backing roller; and (c) generating an electrostatic field across a gap between the moving web and the liquid composition immediately prior to the dynamic wetting line, said electrostatic field having a strength greater than or equivalent to that produced by applying a voltage differential of at least about 300 V between the conductive surface of a backing roller and the liquid composition.

2. A method as recited in claim 1 wherein:

the groove pitch is not more than about eight per millimeter.

3. A method as recited in claim 2 wherein:

each groove of the plurality of grooves has a depth in the range of from about 20 $\mu$m to about 80 $\mu$m.

4. A method as recited in claim 1 wherein:

the groove pitch is about four per millimeter.

5. A method as recited in claim 4 wherein:

each groove of the plurality of grooves has a depth of about 45 $\mu$m.

6. A method as recited in claim 5 wherein:

each groove of the plurality of grooves has a width of about 200 $\mu$m.

7. A method as recited in claim 3 wherein:

each groove of the plurality of grooves has a width of about 200 $\mu$m.

8. A method as recited in claim 5 wherein:

each groove of the plurality of grooves is arcuate in cross section.

9. A method as recited in claim 3 wherein:

each groove of the plurality of grooves is arcuate in cross section.

10. A method as recited in claim 1 wherein:

each groove of the plurality of grooves is discrete, comprising an individual annular channel around the circumference of the backing roller, and the plurality of grooves are parallel to one another.

11. A method as recited in claim 1 wherein:

each groove of the plurality of grooves is a spiral segment intercepting adjacent spiral segments to form a single, continuous spiral channel.

12. A method as recited in claim 1 wherein:

the plurality of circumferential grooves in the rotatable backing roller form a pattern having a width that is at least as wide as a width of the liquid composition being delivered thereto by the applicator.

* * * * *